US011014734B1

(12) United States Patent
Olsson et al.

(10) Patent No.: US 11,014,734 B1
(45) Date of Patent: May 25, 2021

(54) MARKING PAINT APPLICATOR APPARATUS

(71) Applicant: SeeScan, Inc., San Diego, CA (US)

(72) Inventors: Mark S. Olsson, La Jolla, CA (US); Michael E. Turgeon, San Diego, CA (US)

(73) Assignee: SEESCAN, INC., San Diego, CA (US)

( * ) Notice: Subject to any disclaimer, the term of this patent is extended or adjusted under 35 U.S.C. 154(b) by 0 days.

(21) Appl. No.: 16/791,979

(22) Filed: Feb. 14, 2020

Related U.S. Application Data

(63) Continuation of application No. 16/105,857, filed on Aug. 20, 2018, now Pat. No. 10,569,951, which is a continuation of application No. 14/798,177, filed on Jul. 13, 2015, now Pat. No. 10,059,504, which is a continuation of application No. 13/766,706, filed on Feb. 13, 2013, now Pat. No. 9,085,007, which is a continuation of application No. 12/827,993, filed on Jun. 30, 2010, now abandoned, which is a continuation of application No. 11/782,572, filed on Jul. 24, 2007, now abandoned.

(Continued)

(51) Int. Cl.

| | |
|---|---|
| ***B65D 83/36*** | (2006.01) |
| ***B65D 83/20*** | (2006.01) |
| ***B05B 12/00*** | (2018.01) |
| ***B05B 15/62*** | (2018.01) |
| ***B05B 12/20*** | (2018.01) |
| ***B05C 17/06*** | (2006.01) |
| ***B05B 15/63*** | (2018.01) |
| ***B65D 83/46*** | (2006.01) |

(52) U.S. Cl.

CPC ..... *B65D 83/36* (2013.01); *B05B 12/00* (2013.01); *B05B 12/004* (2013.01); *B05B 12/20* (2018.02); *B05B 15/62* (2018.02); *B65D 83/203* (2013.01); *B65D 83/208* (2013.01); *B05B 15/63* (2018.02); *B05C 17/06* (2013.01); *B65D 83/46* (2013.01)

(58) Field of Classification Search

CPC ..... B65D 83/203; B65D 83/208; B65D 83/36

USPC ... 239/525, 146, 147, 150, 154, 722, 71, 73; 116/211, 209; 222/174, 192

See application file for complete search history.

(56) References Cited

U.S. PATENT DOCUMENTS

| | | | |
|---|---|---|---|
| 3,270,369 | A | 9/1966 | Mandell |
| 3,310,264 | A | 3/1967 | Appleton |

(Continued)

FOREIGN PATENT DOCUMENTS

| | | |
|---|---|---|
| EP | 1852365 A1 | 11/2007 |
| WO | WO 9112119 | 8/1991 |
| WO | WO 9424584 | 3/1994 |

OTHER PUBLICATIONS

Bearden, Tom, "New Identification Technology Raises Concerns Over Privacy," PBS Online NewsHour, Aug. 17, 2006, pp. 1-7, http://www.pbs.org/newshour/bb/science-july-dec06-rfid_08-17.html.

(Continued)

*Primary Examiner* — Justin M Jonaitis

(74) *Attorney, Agent, or Firm* — Steven C. Tietsworth, Esq.

(57) ABSTRACT

A marking paint applicator apparatus is disclosed. The marking paint application may include an elongated support structure and a trigger mechanism, a receptacle for holding paint, and an actuating mechanism for selectively controlling release of the paint.

13 Claims, 11 Drawing Sheets

Related U.S. Application Data

(60) Provisional application No. 60/822,621, filed on Aug. 16, 2006.

(56) References Cited

U.S. PATENT DOCUMENTS

| | | | |
|---|---|---|---|
| 3,485,206 | A | 12/1969 | Smrt |
| 3,871,557 | A | 3/1975 | Smrt |
| 3,972,038 | A | 7/1976 | Fletcher |
| 3,974,491 | A | 8/1976 | Sipe |
| 4,258,320 | A | 3/1981 | Schonstedt |
| 4,387,340 | A | 6/1983 | Peterman |
| 4,388,592 | A | 6/1983 | Schonstedt |
| 4,520,317 | A | 5/1985 | Peterman |
| 4,536,710 | A | 8/1985 | Dunham |
| 4,539,522 | A | 9/1985 | Schonstedt |
| 4,590,425 | A | 5/1986 | Schonstedt |
| 4,639,674 | A | 1/1987 | Rippingale |
| 4,712,094 | A | 12/1987 | Bolson, Sr. |
| 4,747,207 | A | 5/1988 | Schonstedt |
| 4,803,773 | A | 2/1989 | Schonstedt |
| 4,818,944 | A | 4/1989 | Rippingale |
| 4,839,623 | A | 6/1989 | Schonstedt |
| 4,839,624 | A | 6/1989 | Schonstedt |
| 5,001,430 | A | 3/1991 | Peterman |
| 5,006,806 | A | 4/1991 | Rippingale |
| 5,014,008 | A | 5/1991 | Flowerdew |
| 5,017,873 | A | 5/1991 | Rippingale |
| 5,043,666 | A | 8/1991 | Tavernetti |
| 5,045,368 | A | 9/1991 | Cosman |
| 5,065,098 | A | 11/1991 | Salsman |
| 5,093,622 | A | 3/1992 | Balkman |
| 5,097,211 | A | 3/1992 | Schonstedt |
| 5,114,517 | A | 5/1992 | Rippingale |
| 5,122,750 | A | 6/1992 | Rippingale |
| 5,136,245 | A | 8/1992 | Schonstedt |
| 5,368,202 | A | 11/1994 | Smrt |
| 5,918,565 | A | 7/1999 | Casas |
| 6,053,260 | A | 4/2000 | Boon |
| 6,064,940 | A | 5/2000 | Rodgers |
| 6,294,022 | B1 | 9/2001 | Eslambolchi |
| 6,437,708 | B1 | 8/2002 | Brouwer |
| 6,723,375 | B2 | 4/2004 | Zeck |
| 6,766,253 | B2 | 7/2004 | Burns |
| 7,009,399 | B2 | 3/2006 | Olsson |
| 7,048,151 | B1 | 5/2006 | Wertz |
| 7,175,104 | B2 | 2/2007 | Allen, IV |
| 7,175,106 | B2 | 2/2007 | Roman |
| 7,640,105 | B2 | 12/2009 | Nielsen |
| 7,930,103 | B2 | 4/2011 | Young |
| 8,118,192 | B2 | 2/2012 | Daugherty |
| 8,146,068 | B2 | 3/2012 | Tal |
| 8,290,204 | B2 | 10/2012 | Nielson |
| 8,401,791 | B2 | 3/2013 | Nielson |
| 8,407,001 | B2 | 3/2013 | Nielson |
| 8,478,523 | B2 | 7/2013 | Nielson |
| 10,569,951 | B2 * | 2/2020 | Olsson ..... B05B 12/00 |
| 2002/0053608 | A1 * | 5/2002 | Zeck ..... E21B 47/0232 239/150 |
| 2009/0204238 | A1 | 8/2009 | Nielsen |
| 2009/0208642 | A1 | 8/2009 | Nielson |
| 2010/0198663 | A1 | 8/2010 | Nielsen |

OTHER PUBLICATIONS

Advanced Mapping, Underground Utility Mapping Specialists, internet ad, pp. 1-2.

Common Ground Alliance (CGA), "Best Practices, Version 1.0," Dec. 2003.

Central Valley Chapter California Land Surveyors Association, "Corporate Sponsors," Website, http://www.californiacentralvalleysurveyors.org/corporate_sponsors.shtml.

CMH Underground Utlities Ltd., "Mapping and Location Services," Website, 2012, p. 1, Prince George, BC.

Common Ground Alliance, "Study of One-Call Systems and Damage Prevention Best Practices," Report, Aug. 1999, pp. i-252, United States Department of Transportation's (DOT) Research and Special Programs Administration (RSPA) and Office of Pipeline Safety (OPS), USA.

Federal Highway Administration, "Subsurface Utility Engineering," Website, pp. 1-4, United States Department of Transportation, USA.

Western Kentucky University, "GIS for PDC and Facilities Management," pp. 1-8, http://www.wku.edu/pdc/gis/pdc_gis.pdf, USA.

Rogers, Dr. Christopher, et al, "Mapping the Underworld—Enhancing Subsurface Utility Engineering Performance," 87th Transportation Research Board Conference, 2007, pp. 1-10, TBE Group, Washington DC, USA.

Miss Utility—MD/DC Damage Prevention Committee, "Minutes of Maryland/DC Damage Prevention Meeting," Jan. 24, 2006, pp. 1-3, Hanover, MD, USA.

Miss Utility—MD/DC Damage Prevention Committee, "Minutes of Maryland/DC Damage Prevention Meeting," Sep. 26, 2006, pp. 1-3, Hanover, MD, USA.

Li, Dr. Rongxing, "Mobile Mapping—An Emerging Technology for Spatial Data Acquisition," Academic Paper, Sep. 1997, pp. 1-22, Department of Civil and Environmental Engineering and Geodetic Science, Ohio State University, Columbus, OH, USA.

National Mapping and Spatial Data Committee—AM/FM Technical Sub-Committee, "Standard Guideline for Underground Utility Mapping," Report, May 2006, pp. 1-28, Malaysia.

Cardno TBE, "SUE Services," Website, pp. 1-3.

Synergy One Locating, "Subsurface Utility Mapping and Locating," Website, pp. 1-2, USA.

Jamil, Hasan, et al, "Underground Utility Mapping and its Challenges in Malaysia," Engineering Paper, 2012. pp. 1-15, Department of Survey and Mapping Malaysia, Malaysia.

Jamil, Hasan, et al, "Underground Utility Mapping and its Challenges in Malaysia," Presentation, May 2012, pp. 1-27, Department of Survey and Mapping Malaysia, Malaysia.

* cited by examiner

MARKING PAINT APPLICATOR APPARATUS

FIELD

This disclosure relates generally to devices for marking items on the ground or on another surfaces.

BACKGROUND

There are many situations where is it desirable to locate buried utilities such as pipes and cables. For example, prior to starting any new construction that involves excavation, it is important to locate existing underground utilities such as underground power lines, gas lines, phone lines, fiber optic cable conduits, CATV cables, sprinkler control wiring, water pipes, sewer pipes, etc. If a back hoe or other excavation equipment hits a high voltage line or a gas line, serious injury and property damage can result. Severing water mains and sewer lines leads to messy cleanups. The destruction of power and data cables can seriously disrupt the comfort and convenience of residents and cost businesses huge financial losses.

Buried objects can be located by sensing an electromagnetic signal emitted by the same. Some cables such as power lines are already energized and emit their own long cylindrical electromagnetic field. Location of other conductive lines necessitates their energizing with an outside electrical source having a frequency typically in a range of approximately 50 Hz to 500 kHz. Location of buried long conductors is often referred to as "line tracing."

In the typical locating operation, an operator will use a portable electronic locator to determine the underground location of a buried utility, sonde, or like object, and will then use an aerosol paint can to mark on the surface of the ground the apparent location of the buried object that has been located. In this way, the location of existing underground utilities can be known to an excavator and can be avoided during excavation, preventing expensive damage and potential personal injury. However, existing locators heretofore have not made it convenient to both locate a buried utility and mark its location on the ground. The conventional approach interrupts the locate process as a result of the necessity of picking up an aerosol paint can and applying paint on the ground to mark a location of a buried pipe or conductor that has been located. This adds time to the locate process, reducing productivity. It also imposes the necessity of stooping or bending in order to apply markings. This interruption also causes the operator to take his or her attention away from the instrument being used to detect the buried utility, thus introducing the risk of an inaccurate marking.

Separately held tools have been developed for holding an aerosol paint can and operating it from a standing position. See for example U.S. Pat. No. 5,368,202 of Smrt. Such stand alone marking paint applicators must be carried and handled separately from the locator. One prior art locator has been designed with a marking paint applicator embedded permanently into its structure. See U.S. Pat. No. 6,723,375 of Zeck et al.

SUMMARY

In accordance with one aspect, a marking paint applicator for a portable locator includes an elongated support structure and a manually moveable trigger mechanism mounted adjacent an upper end of the support structure. At least one bracket assembly is provided for removably connecting the support structure to an antenna mast of the portable locator so that the trigger mechanism will be adjacent a handle of the locator and the trigger mechanism can be squeezed by a finger of an operator's hand while grasping the handle. A receptacle is mounted to the support structure for carrying an inverted aerosol paint can and positioning a valve stem of the aerosol paint can for spraying paint onto the ground. An actuating mechanism is capable of selectively deflecting the valve stem to cause the aerosol paint can to spray paint onto the ground. A linkage connects the trigger mechanism to the actuating mechanism for deflecting the valve stem when the trigger mechanism is squeezed.

Various additional aspects, features, and functions are described subsequently with respect to the appended drawings.

DETAILED DESCRIPTION

The marking paint applicator of the present invention is an accessory which enables an operator of a portable electronic locator used to locate buried utilities to place paint marks on the ground to indicate their determined locations. The marking paint applicator of the present invention is readily attachable to the portable locator and provides a convenient means for simultaneously placing paint marks in the exact location indicated by the locator's display. The accessory requires no change of position or attention-focus on the part of the operator. The operator need not bend down with a spray can, or carry a stand alone paint applicator.

Figure 1:
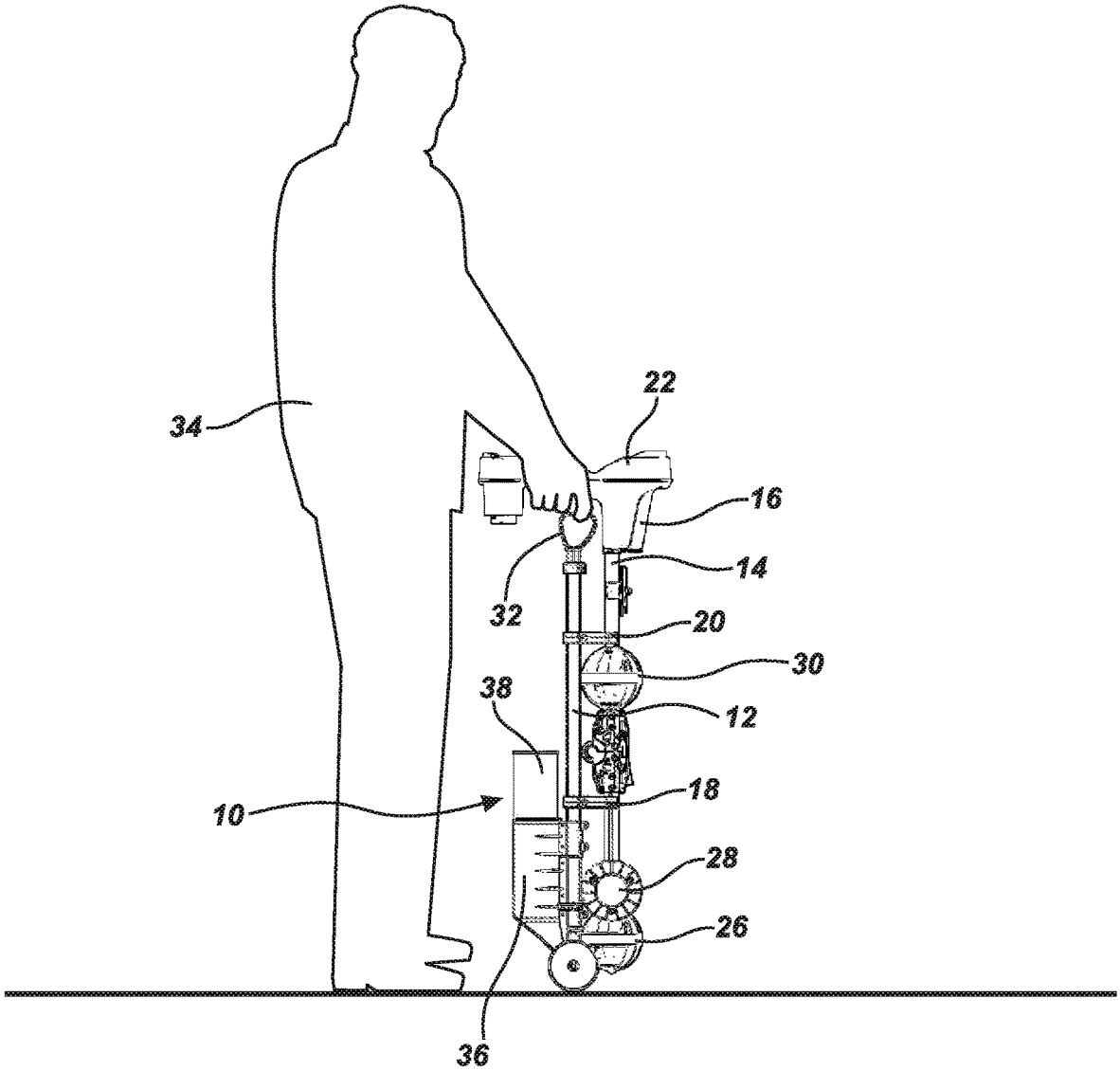
FIG. 1 illustrates the general operation of an embodiment of a marking paint applicator in accordance with the present invention that is removably attached to a portable locator.

Referring to FIG. 1, a marking paint applicator 10 in accordance with an embodiment of the present invention includes a support structure 12 in the form of a tube. The support structure 12 is removably attached to the antenna mast 14 of a portable locator 16 with bracket assemblies in the form of two semi-flexible clips 18 and 20. The use of an elongate tube as the support structure 12 is advantageous in that it can be made of strong, lightweight material, such as plastic or composite material, with a diameter and length comparable to that of the antenna mast 14. However the support structure 12 could be widely varied to comprise any type of frame or combined frame elements for accomplishing the purposes hereafter described. The clips 18 and 20 may be spring-loaded alligator-style clips that firmly clasp the antenna mast 14. Alternative means for releasably attaching the support structure 12 to the exterior of the antenna mast 14 include brackets that can be held together with bolts and nuts, zip-ties, brackets held to the antenna mast with screws, snap-fit components, joiner pieces, etc.

The paint applicator 10 can be advantageously used as an accessory with a portable locator of the type disclosed in U.S. Pat. No. 7,009,399 of Mark S. Olsson et al. granted Mar. 7, 2006, the entire disclosure of which is hereby incorporated by reference. That patent discloses a portable electronic locator similar to the portable locator 16 illustrated in FIG. 1. Both have a housing 22, a display 24 (FIGS. 4B and 8) located on the housing 22 and an elongate antenna mast 14 (FIG. 1) extending from the housing 22 and supporting a plurality of antennas 26, 28 and 30. Both have a horizontally extending handle (not visible in FIG. 1) integrally formed as a part of the housing 22. Both have a circuit (not illustrated) that is at least partially located in the housing 22 for receiving signals from the antennas 26, 28 and 30 induced therein by electromagnetic signals emitted by a buried utility. This circuit is capable of determining a location of the buried utility and indicating a location of the buried utility on the display 24.

Referring still to FIG. 1, a trigger mechanism 32 of the marking paint applicator 10 can be actuated by the index finger of an operator 34 during the locate operation. The support structure 12 is attached to a receptacle 36 for holding an aerosol paint can 38 which can be selectively activated to spray marking paint of any desired color downward by squeezing the trigger mechanism 32 upwardly with the index finger. The aerosol paint can 38 is of a commercially available type widely manufactured for the purpose of making marks on the ground. The aerosol paint can 38 dispenses a stream of brightly colored paint generally along the vertical axis of the cylinder of the can, as opposed to generally orthogonal thereto. The support structure 12, clips 18 and 20, and receptacle 36 are preferably made of non-magnetic material such as plastic in order to minimize signal distortion in the normal process of locating with the locator 16. The receptacle 36 is preferably made up of a split semi-cylindrical holder that due to its shape, dimensions and resilient plastic construction can be spread apart to insert the aerosol paint can 38 in an inverted position. Thereafter the receptacle 36 will squeeze the aerosol paint can 38 to firmly hold it in place. The receptacle 36 has a lip or projections (not illustrated) that extend radially inwardly and engage the end of the aerosol paint can 38 to establish its lowermost position and prevent it from falling out of the receptacle 36.

The receptacle 36 is mounted to the support structure 12 at a predetermined height that places a valve stem 40 (FIG. 5) of the aerosol paint can 38 near the lower end of the locator 16 so that paint sprayed from the aerosol paint can 38 will only need to be ejected a short distance before reaching the ground. This insures a bright, well demarcated line of paint and little chance of wet paint ending up on the antenna mast 14 or antennas 26, 28 or 30. It is not necessary for the valve stem 40 of the aerosol paint can 38 to extend below the lowermost antenna 26 or below the lower end of the support structure 12. Indeed it may be desirable for the valve stem 40 to be a few inches above the lower end of the locator 16.

Figure 2:
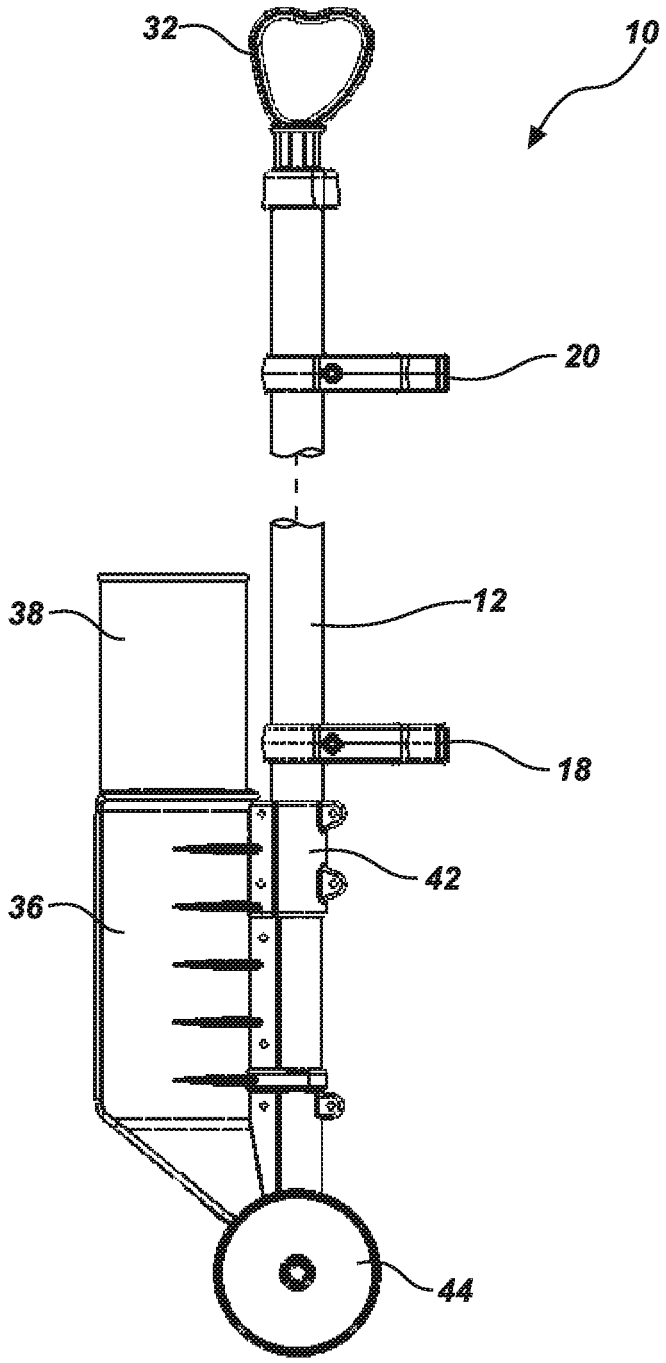
FIG. 2 is an enlarged fragmentary side elevation view of the paint applicator of FIG. 1 illustrating its receptacle loaded with an aerosol paint can and its operator-actuated trigger mechanism.
Figure 3:
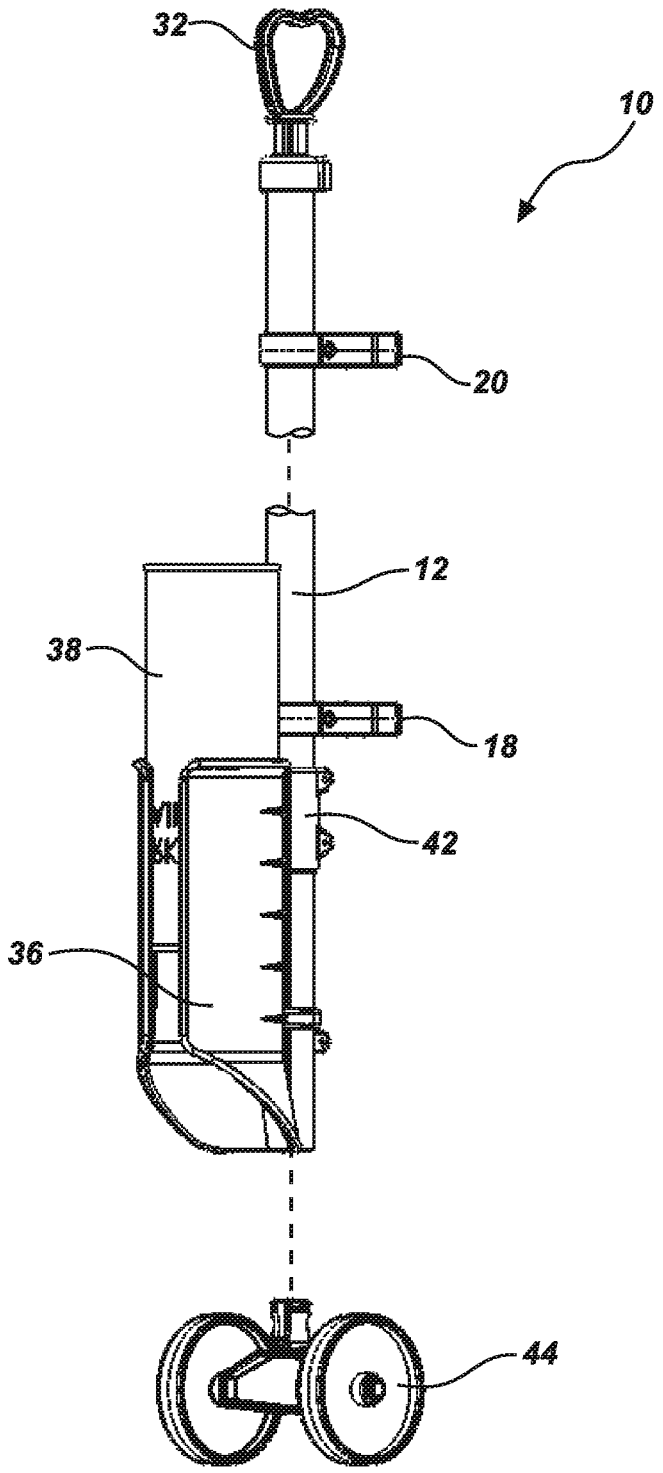
FIG. 3 is a view similar to FIG. 2, slightly rotated about a vertical axis, illustrating the detachment of the optional pair of wheels from the paint applicator of FIG. 1.

Referring to FIG. 2, an attachment mount 42 attaches the receptacle 36 to the support structure 12. The support structure 12 is removably equipped with a pair of wheels 44 at the lower end thereof to enable smooth and steady transport of the locator 16 along the ground and straight-line painting in the desired area as illustrated in FIG. 1. Wheels 44 can be detached as illustrated in FIG. 3 by removing locking pins, bolt assemblies or other means of attachment (not illustrated).

Figure 4A:
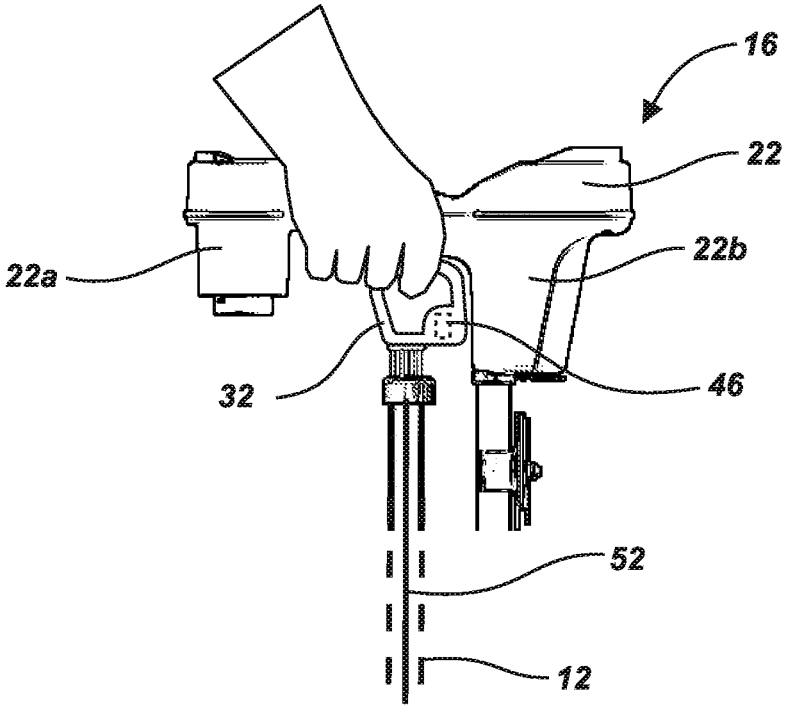
FIG. 4A is an enlarged fragmentary portion of FIG. 1 illustrating the operation of the trigger mechanism of the paint applicator of FIG. 1.
Figure 4B:
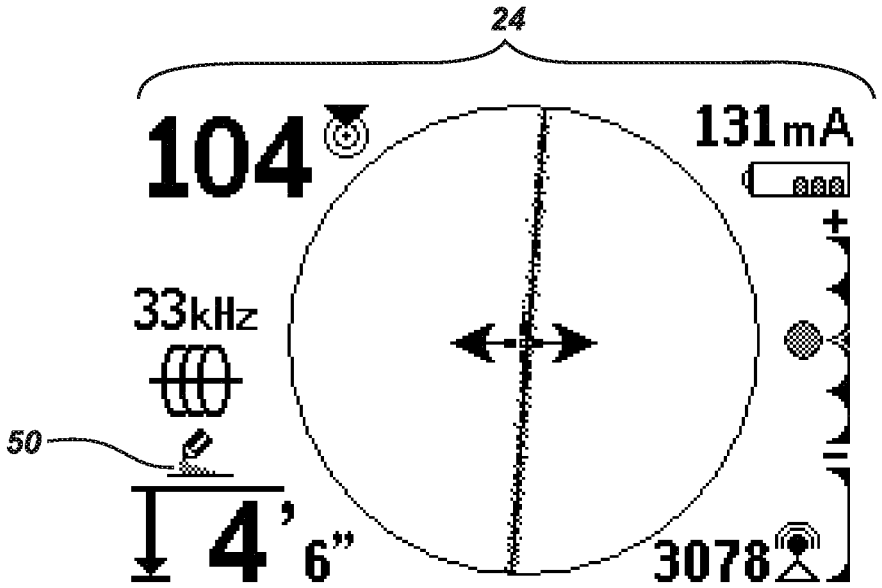
FIG. 4B illustrates an icon displayed by the locator when the trigger mechanism of the paint applicator of FIG. 1 has been squeezed by an operator.

Referring to FIG. 4A, the trigger mechanism 32 may be a rigid loop of injection molded plastic with a shape suitable for pulling with an operator's index finger. As best seen in FIG. 1, the operator wraps his or her thumb around the horizontal handle of the locator 16. The handle connects a rearward portion 22*a* of the housing 22 with a forward portion 22*b* of the housing 22. The support structure 12 and clips 18 and 20 (FIG. 1) are dimensioned and configured to place the trigger mechanism 32 at the appropriate location relative to the handle of the locator 16 for the best ergonomic utilization of the trigger mechanism 32 by the hand of an operator that is simultaneously being used to grasp the handle to carry the locator 16.

Referring still to FIG. 4A, a position indicating element in the form of a permanent magnet 46 is embedded in the trigger mechanism 32 and moves vertically adjacent the exterior of the lower forward portion 22*b* of the locator housing 22 when activation occurs. A sensor such as a reed switch 48 (FIG. 8) is mounted within the locator housing portion 22*b* and detects the movement of the permanent magnet 46. When the trigger mechanism 32 is manually pulled upwardly, the permanent magnet 46 moves into registration or alignment with the reed switch 48. This causes the contacts of the reed switch 48 to close, in turn causing the display 24 (FIG. 4B) of the locator 16 to indicate a paint icon 50 (FIG. 4B) that tells the operator 34 that a paint marking has just been made. Other forms of sensors can be used besides the reed switch 48, such as a Hall effect sensor (not shown). The marking paint applicator 10 can also transmit a signal optically or wirelessly to the locator 16 to indicate that the trigger mechanism 32 has been activated and paint has been sprayed on the ground.

Figure 5:
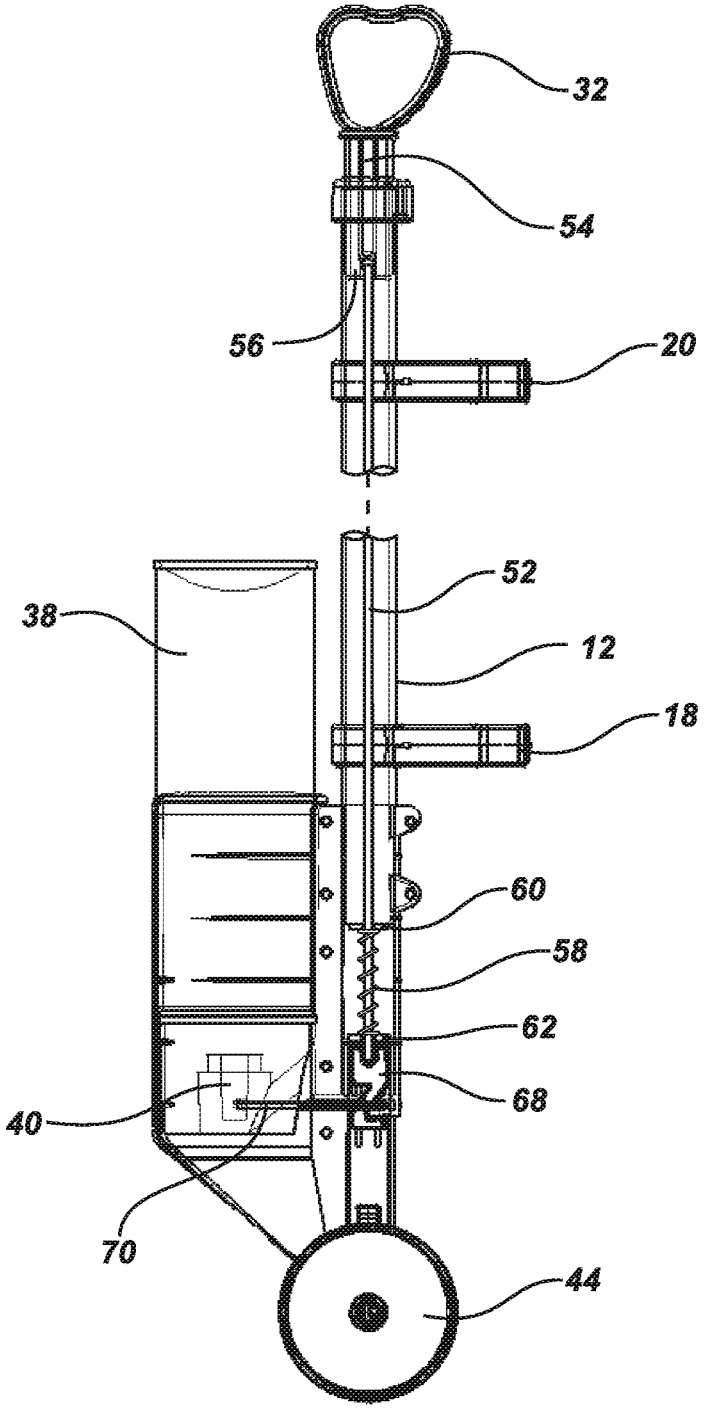
FIG. 5 is a fragmentary vertical sectional view of the paint applicator of FIG. 1 illustrating details of its linkage and valve stem actuating mechanism.
Figure 6A:
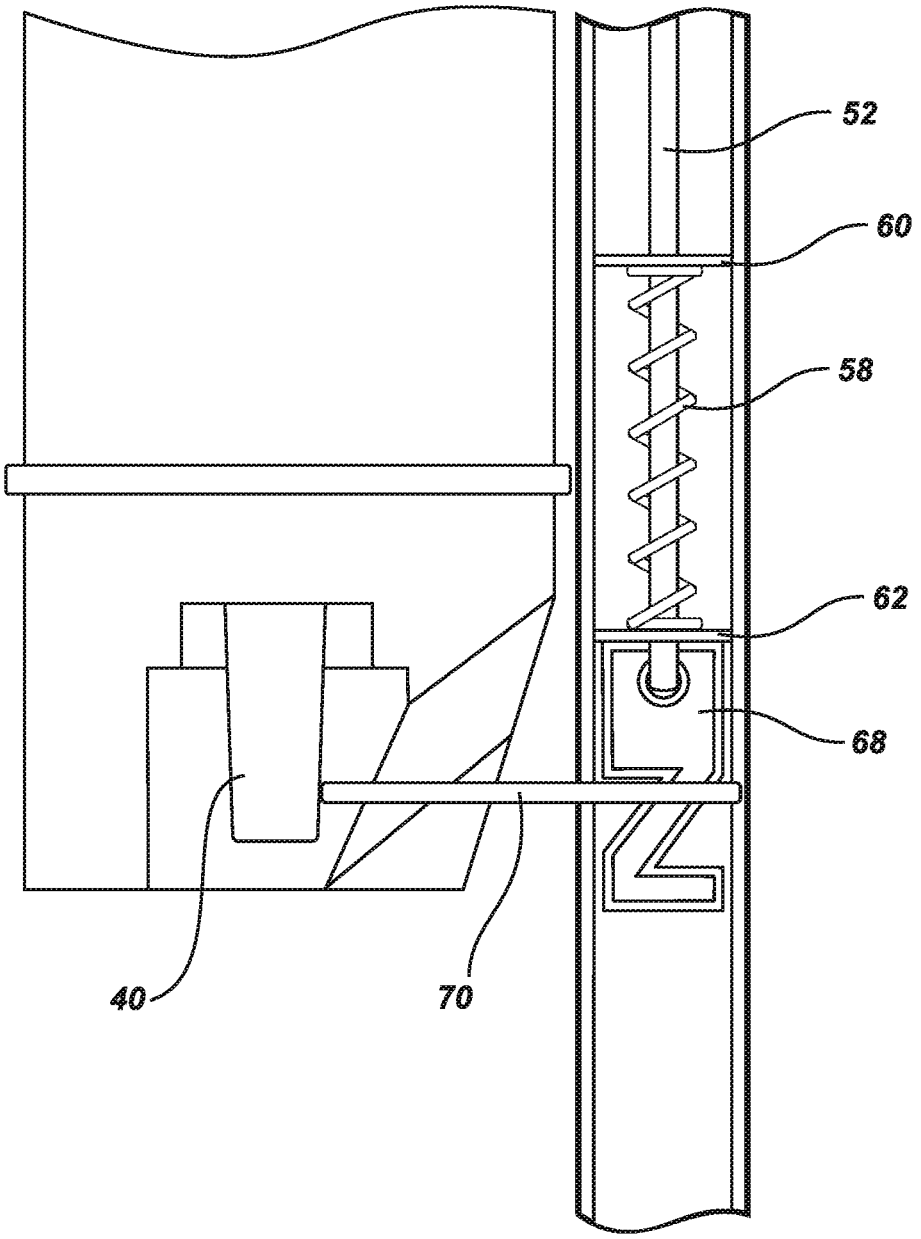
FIG. 6A is an enlarged portion of FIG. 5 illustrating further details of the valve stem actuating mechanism in its OFF state.
Figure 6B:
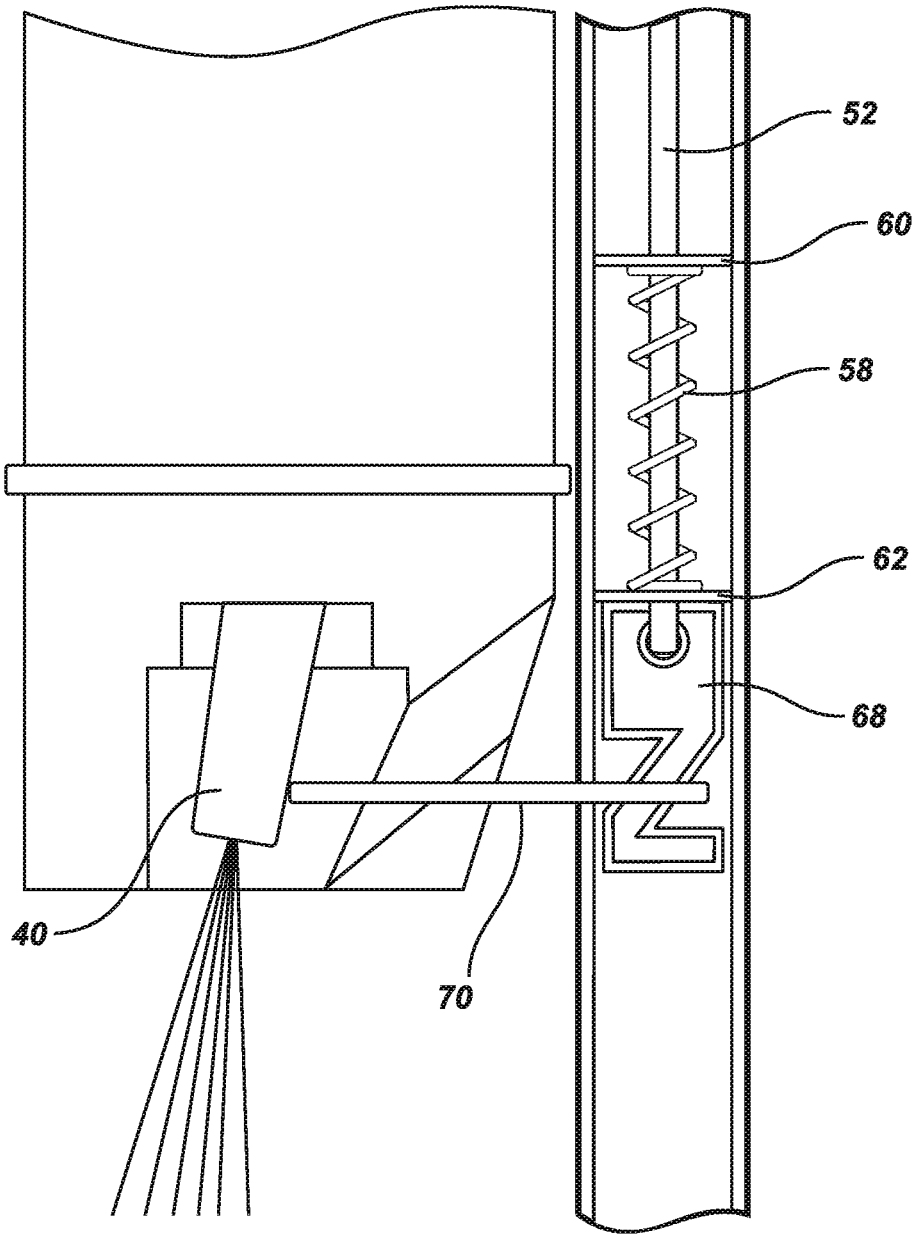
FIG. 6B is a view similar to FIG. 6A illustrating the valve stem actuating mechanism in its ON state.

Referring to FIG. 5, a linkage including a rod 52 and a coupling 54 are connected to the trigger mechanism 32 such that they move upwardly when the trigger mechanism 32 is squeezed. The rod 52 extends centrally within the support structure 12. A bushing 56 centers the rod 52 at the upper end of the support structure 12. Referring to FIG. 6A, the rod 52 is loaded with a coil spring 58 which returns it to its lowermost starting position when the trigger mechanism 32 is released. The coil spring 58 is compressed between a fixed divider wall 60 and a movable divider wall 62. The rod 52 extends through holes in the centers of the divider walls 60 and 62. A valve stem actuating mechanism includes an angle-block 68 that is connected to the lower end of the rod 52. The valve stem actuating mechanism translates the vertical motion of the rod 52 into lateral motion. The valve stem actuating mechanism further includes a tongue 70 that is situated so as to be moved outward by the raising of the angle-block 68. As illustrated in FIG. 6B, upward vertical movement of the spring-loaded rod 52 lifts the angle-block 68. This moves the tongue 70 laterally, and its distal end presses against the valve stem 40 of the aerosol paint can 38 visible in FIG. 5. As illustrated in FIG. 6B, this causes the valve stem 40 to deflect laterally and open. A stream of paint is then directed downwardly onto the ground at a location beneath the end of the locator 16. When the trigger mechanism 32 is released, the spring 58 biases the trigger mechanism 32 to an OFF (no spray) state in which the valve stem actuator mechanism is not deflecting the valve stem 40.

Figure 7:
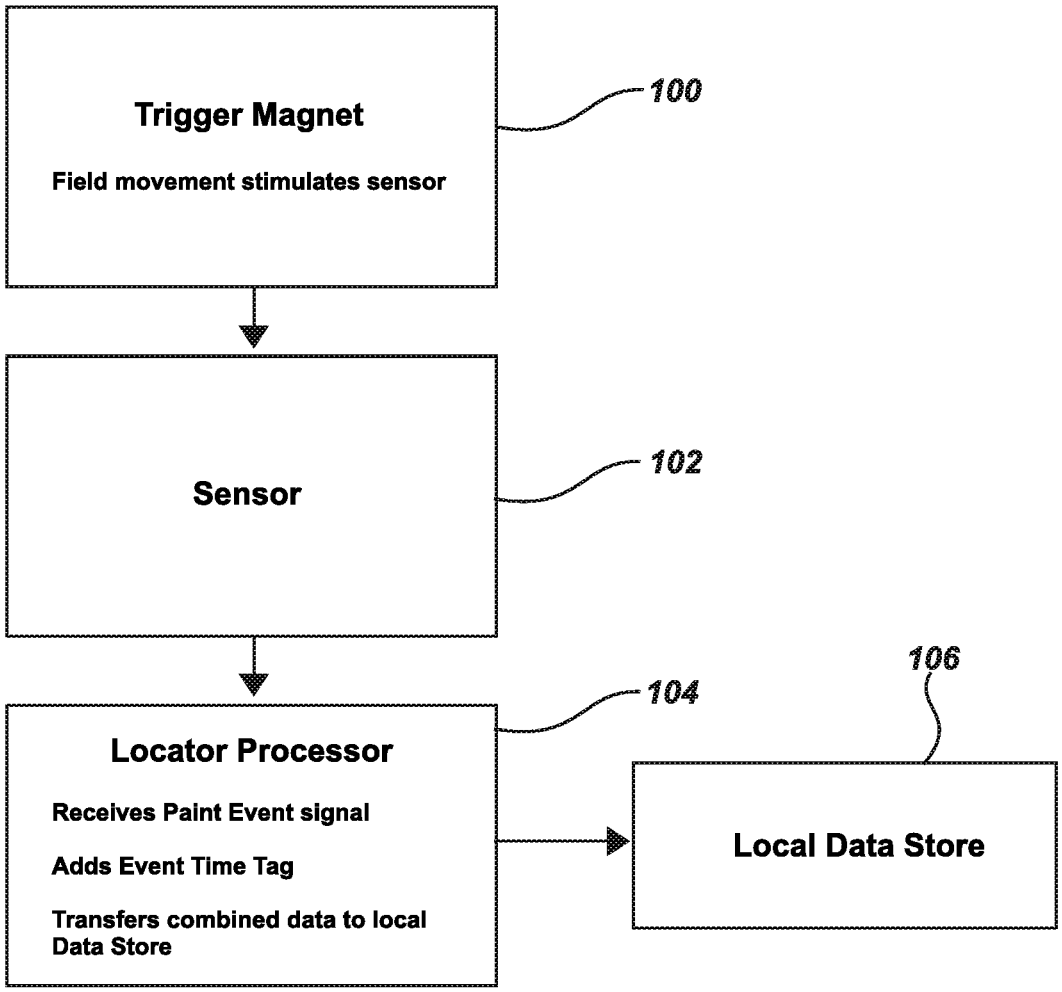
FIG. 7 is a flow diagram illustrating the process by which actuation of the trigger mechanism of the paint applicator of FIG. 1 will cause the locator to log a paint marking.
Figure 8:
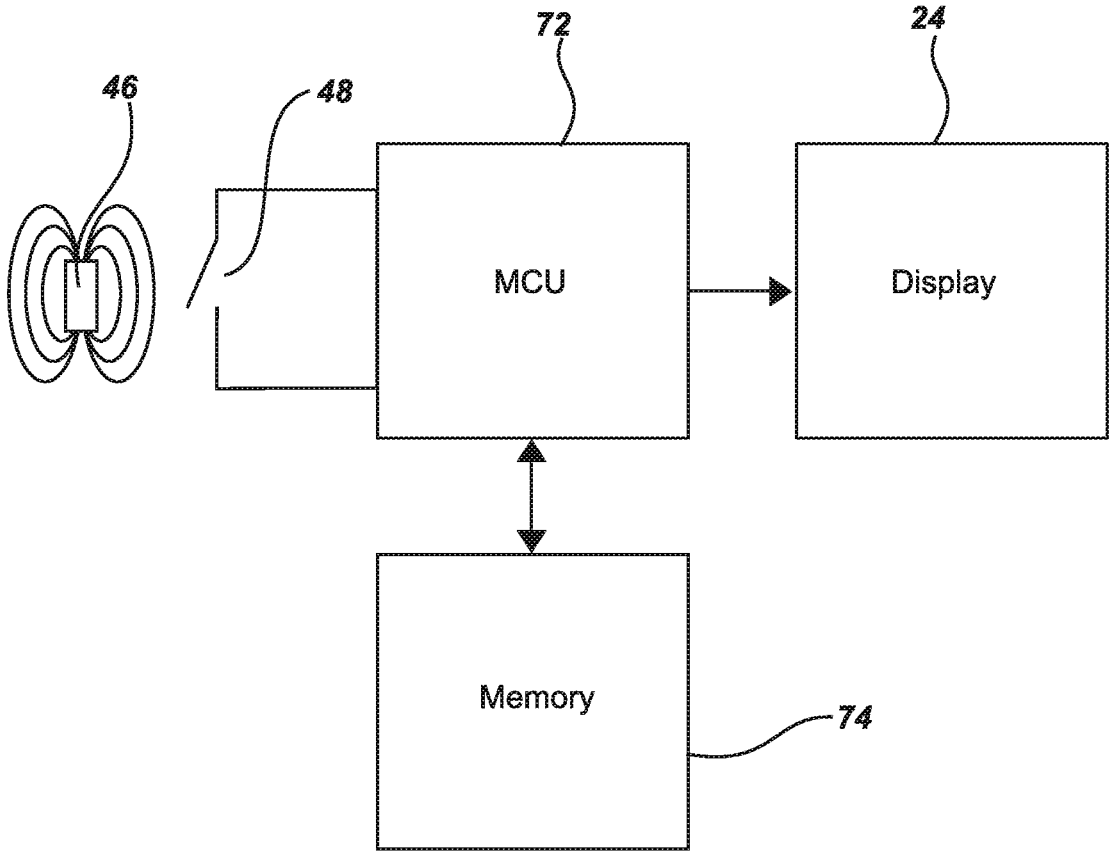
FIG. 8 is a block diagram illustrating the manner in which an embedded magnet of the paint applicator of FIG. 1 actuates a sensor in the locator, producing signals which are time-tagged and stored in a local data storage and indicated on the locator's LCD display.

FIG. 7 is a flow diagram illustrating the process by which actuation of the trigger mechanism 32 of the paint applicator 10 of FIG. 1 will cause the locator 16 to tag the marking event. In step 100 the permanent magnet 46 is moved by the trigger mechanism 32. In step 102 this movement is detected by the reed switch 48 which transmits a signal to the locator's microprocessor or micro-controller MCU 72 (FIG. 8). In step 104 a paint-event time stamp is added by the locator 16 to tag the event. In step 106 the data is stored with its time-tag in data storage onboard the locator 16 and may be used in computing mapping information, downloaded for use in other devices, or the like.

Figure 9A:
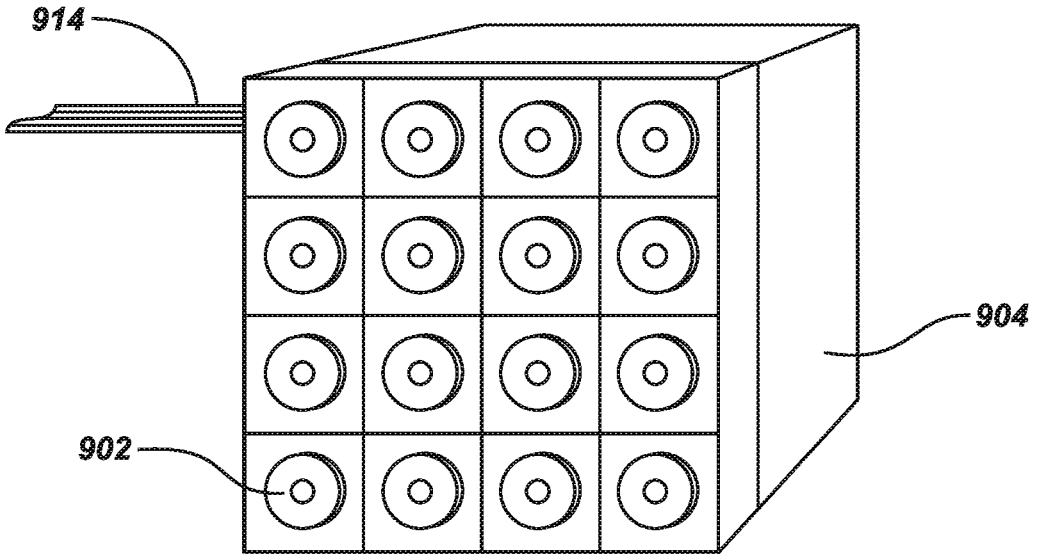
FIG. 9A illustrates an alternate embodiment of the present invention that utilizes a matrix-array of emission orifices fed from a single reservoir.

FIG. 8 is a block diagram illustrating the manner in which the embedded permanent magnet 46 closes the reed switch 48 mounted in the locator 16, producing signals which are time-tagged and stored in a local data storage and indicated on the locator's LCD display 24. The reed switch 48 is connected to the MCU 72 of the locator 16, possibly through an interface (not illustrated). The MCU 72 in turn is connected to the LCD display 24, possibly through a driver (not illustrated). The MCU 72 preferably has a bi-directional connection with an on-board memory or local data store 74 for logging the paint marking event Referring now to FIG. 9A, an alternate embodiment of the present invention employs an array of electronically controllable emission orifices 902 drawing from a paint reservoir 904 which is pressurized. The emission orifices 902 open and close based on control signals received on a control channel 914. In this way, individual characters, numbers, or other forms can be created to add information to the painted mark caused by the operator.

Figure 9B:
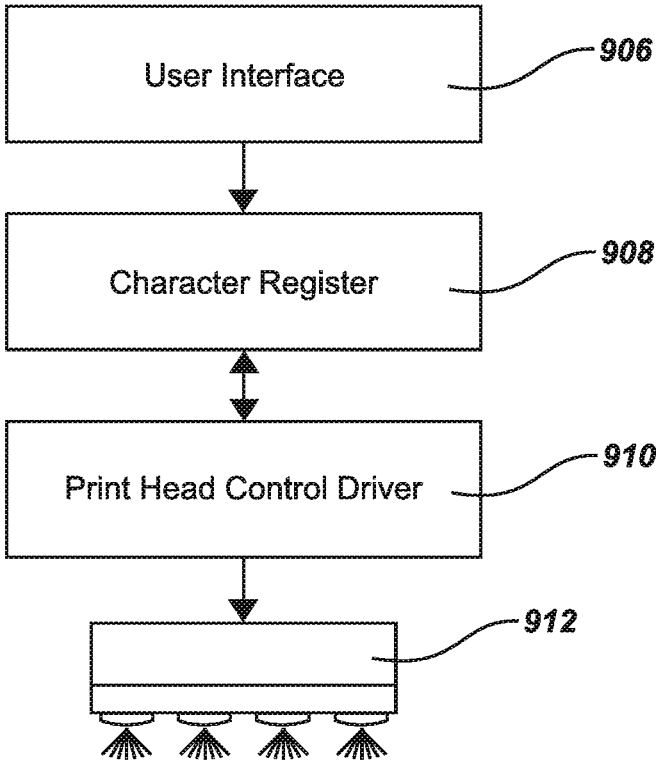
FIG. 9B is a block diagram of a control system for the emission orifices of FIG. 9A.

Referring to FIG. 9B a user interface 906 is connected to a character register 908 in the form of a memory that stores character or other byte strings. The character register 908 is in turn connected to a print head control driver 910 that translates user input into control signals and communicates these control signals to an emitter array 912. The control signals cause individual emission orifices 902 (FIG. 9A) to open and close in a timed sequence calculated to produce the desired patterns in the painted markings, in a fashion similar to the manner in which an ink jet print head prints graphics and alphanumeric indicia on paper.

Figure 10A:
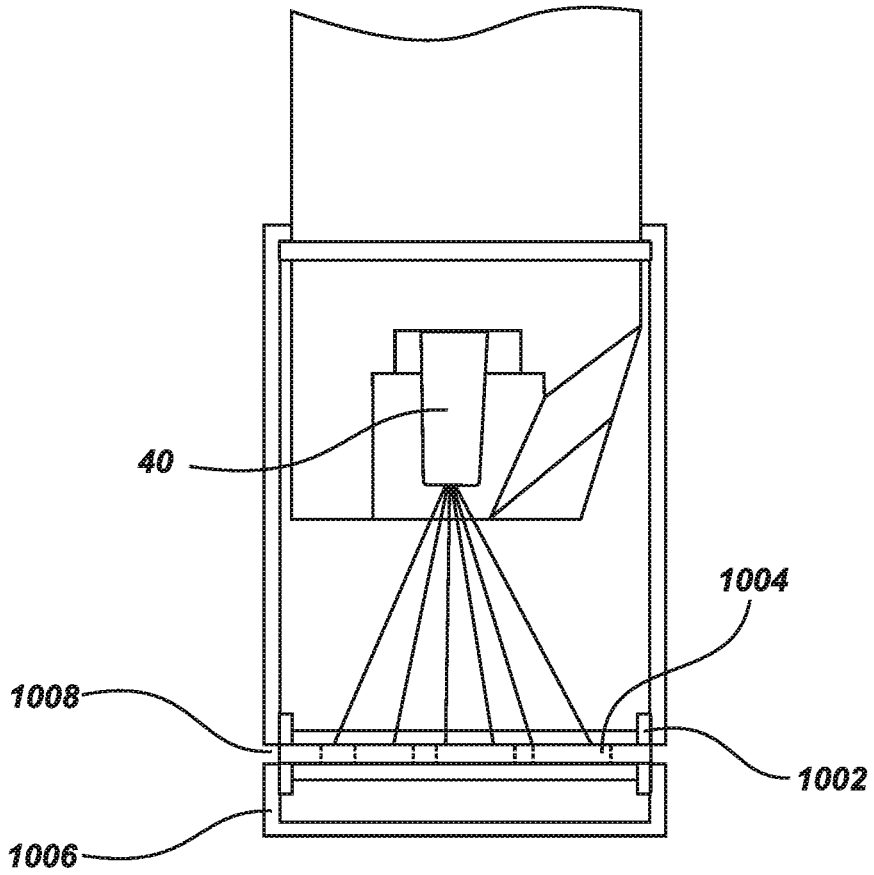
FIG. 10A illustrates an alternate embodiment of the present invention which utilizes a stencil beneath the nozzle of the spray can to form recognizable patterns (characters, numbers, etc.) on the pavement.

Referring to FIG. 10A, in another alternate embodiment a formed collar 1006 contains a slot 1008 and tabs 1002 or similar means to retain a stencil 1004 cut to portray a desired pattern in the spray marking. The stencil 1004 is held by the collar 1006 directly under the spray-can valve stem 40 (FIG. 6B). The form of the cutouts on the stencil 1004 governs the pattern made by the paint reaching the ground. The user simply selects the desired stencil 1004 and fixes it in place in the collar 1006 before marking.

Figure 10B:
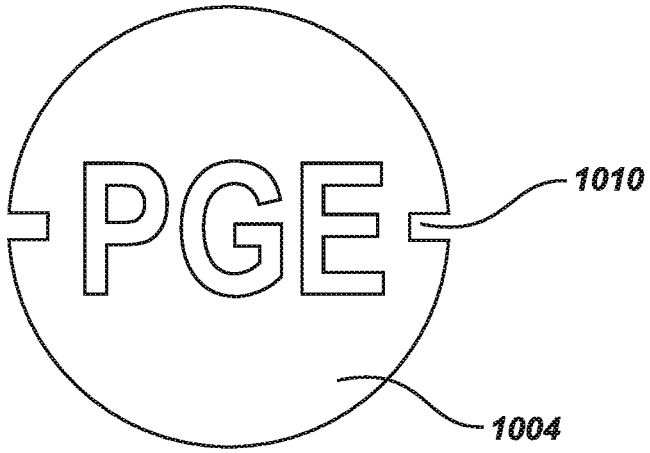
FIG. 10B is a plan view of a representative stencil used in the alternate embodiment of FIG. 10A.

FIG. 10B illustrates an example of the stencil 1004. It may be formed from a semi-rigid plastic sheet. The sheet material is die cut into a circular shape, with cutouts representing letters or other indicia, and peripheral notches 1010. The stencil 1004 may be slid into collar 1006 (FIG. 10A) and locked in place by tabs 1002 formed on the collar 1006. The stencil 1004 enables the operator to mark his locates, in this example, with a utility company identifier. In the example illustrated in FIG. 10B, the company identifier is the acronym PGE, which stands for Pacific Gas & Electric.

Conventional spray can markers use the color of the paint alone to provide an indication of the type and location of the detected utility. The alternate embodiments of FIGS. 9B and 10A add to this limited information by providing the ability to add symbols, numbers or characters to the sprayed markings.

Persons skilled in the art of locating underground utilities will appreciate that we have invented a new combination of a portable electronic locator with a detachable external marking paint applicator that can optionally communicate with the locator for logging a paint marking event. The marking paint applicator is advantageously externally mounted on, and carried by, the locator. Heretofore operators had to either bend over to use a conventional aerosol paint can, carry a separate stand alone paint marking applicator, or employ a complex locator with an internally integrated aerosol paint can with a complicated electrically actuated valve stem actuator. Prior marking paint applicators used with portable locators lack the flexibility of readily attaching to, and detaching from, the locator, which is a distinct need in the industry. Moreover, locating or line tracing requires marking capabilities with ease of use and minimal distraction from the instrument and these functions are advantageously achieved with our invention. As illustrated in FIG. 1, the marking paint applicator 10 can be actuated by the same hand that is carrying the locator, allowing the operator 34 the freedom to use his or her other hand to hold a cell phone, clip board, beverage, etc. Other aerosol paint cans of various colors can be conveniently carried by the operator 34 in a holster (not shown) worn around the waist. Specific industry standard colors designate different types of cables and pipes such as power, communications, water, gas, sewer and so forth. These other aerosol paint cans may be swapped into and out of the receptacle 36 as needed.

Other embodiments of the marking paint applicator of the present will be appreciated by those skilled in the art in view of these teachings set forth above. For example, the receptacle need not be a split cylinder but could be any means for receiving and holding a conventional cylindrical aerosol paint can made for marking the location of buried utilities, such as a pair of plastic loops, arms, a shelf, zip ties, radial clamps, suction cups, tape, Velcro fasteners strips, elastic straps, etc. The support structure 12 and the receptacle 36 could be formed as one integral structure. The linkage and valve stem actuation mechanism for engaging the valve stem could be widely varied. See for example, the disclosures of U.S. Pat. No. 3,485,206 of Smrt, U.S. Pat. No. 5,368,202 of Smrt, U.S. Pat. No. 6,294,022 of Eslambolchi et al., U.S. Pat. No. 6,723,375 of Zeck et al., U.S. Pat. No. 7,048,151 or Wertz et al., the disclosures of which are incorporated by reference herein.

The rod 52 (see FIG. 5) could be replaced with a flat arm or a cable. An electrically activated mechanism, e.g. a motor of solenoid driven mechanism, could be used for selectively deflecting the valve stem to cause the aerosol paint can to spray paint onto the ground when the trigger mechanism is squeezed, thereby eliminating the need for any mechanical linkage operatively connecting the trigger mechanism 32 and the mechanism that deflects the valve stem 40. The trigger mechanism 32 can be varied for actuation by other fingers, the thumb, or the entire hand. The trigger mechanism could be provided in the form of a push button or other type of switch operatively connected to an electrical valve stem actuating mechanism via wires or other conductors.

The support structure 12 (see FIG. 1) need not be attached solely to the antenna mast 14 and instead could be solely attached to the locator housing 22, or the support structure 12 could be attached to both the antenna mast 14 and the housing 22. Where the support structure 12 is releasably attached to the housing various forms of attachment means can be utilized such as screws, bolts, brackets, Velcro strips, snaps, snap-fit components, joiner pieces, elastic straps, etc. Therefore, the protection afforded our invention should only be limited in accordance with the following claims and their equivalents.

We claim:

1. A marking paint locator applicator, comprising:

a portable locator, comprising;

an elongate element;

one or more fastener mechanisms located on the elongate element; and one or more electromagnetic antennas located along a length of the elongated element for generating output signals corresponding to a sensed electromagnetic field emitted from a hidden or buried utility; and a marking paint applicator, comprising:

a support structure including a fastener apparatus for removably attaching the marking paint applicator to the portable locator fastener mechanisms;

a trigger mechanism;

a receptacle mounted to the support structure for holding an aerosol paint can and positioning a valve stem of the aerosol paint can for spraying paint onto the ground;

an actuating mechanism for controlling the valve stem so as to cause the aerosol paint can to spray paint for deployment on the ground; and a sensor operatively coupled to the actuation mechanism to provide an output signal upon actuation to the portable locator so as to indicate paint deployment for logging on the portable locator, including time tagging;

wherein the elongate element of the portable locator is substantially the same length as the marking paint applicator.

2. The applicator of claim 1, wherein one or both of the receptacle and support structure comprise a non-metallic material for minimizing magnetic field distortion of magnetic field signals received by the portable locator.

3. The applicator of claim 1, wherein the support structure and receptacle are formed as a single integrated unit.

4. The applicator of claim 1, further including one or more wheels coupled to the support structure.

5. The applicator of claim 1, wherein the portable locator includes a handle element positioned near the top end of the locator when positioned in a vertical orientation.

6. The applicator of claim 1, wherein the portable locator includes an activation input to receive a marking paint application signal from the applicator.

7. The applicator of claim 1, wherein the one or more electromagnetic antennas comprise omnidirectional antennas for measuring magnetic field signals at three orthogonal dimensions.

8. The applicator of claim 1, wherein the paint applicator includes a matrix array of emission orifices to deploy paint as individual characters, numbers, or symbols.

9. The applicator of claim 1, wherein the paint applicator deploys paint through a stencil.

10. The applicator of claim 1, wherein the portable locator further includes a GPS receiver.

11. The applicator of claim 1, wherein the portable locator further includes an accelerometer.

12. The applicator of claim 1, wherein the portable locator stores one or more of a buried utility position and depth in conjunction with a dispensed paint time tag.

13. The applicator of claim 1, wherein the portable locator includes a display for displaying a determined depth of a buried utility along with an indication that paint has been dispensed.

* * * * *